US007658286B2

(12) United States Patent
Murray

(10) Patent No.: US 7,658,286 B2
(45) Date of Patent: Feb. 9, 2010

(54) PACKAGE WITH INTEGRATED TRACKING DEVICE AND METHOD AND APPARATUS OF MANUFACTURE

(75) Inventor: R. Charles Murray, Lakewood Ranch, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 91 days.

(21) Appl. No.: 11/686,666

(22) Filed: Mar. 15, 2007

(65) Prior Publication Data

US 2007/0217717 A1 Sep. 20, 2007

Related U.S. Application Data

(60) Provisional application No. 60/782,526, filed on Mar. 15, 2006.

(51) Int. Cl.
*B65D 85/00* (2006.01)
*B65D 30/22* (2006.01)

(52) U.S. Cl. ..... 206/459.1; 206/459.5; 383/40

(58) Field of Classification Search ..... 206/459.5, 206/459.1; 340/572.8; 383/38, 40, 63, 80, 383/100, 120, 906
See application file for complete search history.

(56) References Cited

U.S. PATENT DOCUMENTS

| | | | |
|---|---|---|---|
| 733,449 | A | 7/1903 | Willsie |
| 2,189,174 | A | 2/1940 | Hohl |
| 2,703,671 | A | 3/1955 | Kindseth |
| 3,286,005 | A | 11/1966 | Cook |
| 3,304,977 | A | 2/1967 | Hammons |
| 3,924,008 | A | 12/1975 | Ford et al |
| 4,010,786 | A | 3/1977 | Aguettant et al. |
| 4,078,717 | A | 3/1978 | Stearley |
| 4,326,568 | A | 4/1982 | Burton et al. |
| 4,361,235 | A | 11/1982 | Gautier et al. |
| 4,498,591 | A | 2/1985 | Smith, II |
| 4,717,046 | A | 1/1988 | Brogli et al. |
| 4,848,421 | A | 7/1989 | Froese et al. |
| 4,999,978 | A | 3/1991 | Kohlbach et al. |
| 5,222,535 | A | 6/1993 | Roders |

(Continued)

FOREIGN PATENT DOCUMENTS

WO WO 2004041656 A2 * 5/2004

OTHER PUBLICATIONS

Rick Lingle, RFID Antenna—Embedded RFID, Packaging World, Dec. 2005, p. 27.

*Primary Examiner*—J. Gregory Pickett
(74) *Attorney, Agent, or Firm*—Gifford, Krass, Sprinkle, Anderson & Citkowski, P.C.

(57) ABSTRACT

A package with integral tracking device and method of forming includes a panel having an upper edge, an opposed lower edge and two side edges that form a flexible pouch. A tracking device is disposed within an air pocket formed in a seal. An opening means is integrally formed in the panel for accessing a product contained within the pouch. In another embodiment, the package is a container having a base wall and a side wall extending upwardly from an edge of the base wall. A cover removable encloses the container, and a valve is disposed in the cover for venting a gas from the container. The tracking device is disposed within an enclosed air pocket integrally formed in a base wall or a side wall of the container.

6 Claims, 10 Drawing Sheets

U.S. PATENT DOCUMENTS

| | | | | |
|---|---|---|---|---|
| 5,267,591 | A | 12/1993 | Wakabayashi et al. | |
| 5,433,526 | A | 7/1995 | Wild et al. | |
| 5,485,714 | A | 1/1996 | Montalvo | |
| 6,199,601 | B1 | 3/2001 | Laudenberg | |
| 6,422,753 | B1 | 7/2002 | Thomas | |
| 6,607,764 | B1 * | 8/2003 | Keller | 426/107 |
| 2003/0235027 | A1 * | 12/2003 | Smeyak et al. | 340/572.8 |
| 2004/0185154 | A1 | 9/2004 | Garwood | |
| 2005/0012325 | A1 * | 1/2005 | Franko et al. | 283/81 |

* cited by examiner

PACKAGE WITH INTEGRATED TRACKING DEVICE AND METHOD AND APPARATUS OF MANUFACTURE

CROSS-REFERENCE TO RELATED APPLICATIONS

This application claims priority of U.S. Provisional Patent Application Ser. No. 60/782,526 filed Mar. 15, 2006, which is incorporated herein by reference.

BACKGROUND OF THE INVENTION

1. Field of the Invention

The present invention relates generally to a package for storing a product and, more specifically, to a package with an integrated radio frequency identification tracking device and a method and apparatus for manufacturing the same.

2. Description of the Related Art

Various types of disposable, portable containers are known in the art for storing products. Examples of types of containers include a cardboard box, a metal can, a plastic bottle, a glass bottle or a tray or a flexible pouch. The flexible pouch is increasingly popular, due to its adaptability in storing a variety of products in various forms, including liquids, solids, or some combination thereof. Consumers recognize the convenience of flexible pouches over other types of containers due to their shape, size, shelf life and storage adaptability. Manufacturers recognize the packaging benefits of a flexible pouch, since the pouch can be formed and filled on the same manufacturing line.

The flexible pouch is made from a flexible material, preferably a laminate composed of sheets of plastic or aluminum or other suitable materials. An outer layer of the material may include preprinted information, such as a logo or the like, to provide the consumer with information regarding the contents of the pouch. The pouch includes a front and a back wall. Edges of the panel, such as a side edge, upper edge or lower edge, are joined together using a sealing technique such as bonding or welding. The pouch may be formed and/or filled using conventionally known manufacturing techniques, such as a horizontal form-fill-seal machine with a single or multiple lanes, a flat bed pre-made pouch machine, a vertical form-fill machine, or the like. An example of a method and apparatus for filling a flexible pouch with a product is disclosed in commonly assigned U.S. Pat. No. 6,199,601, which is incorporated herein by reference.

At the same time, various types of disposable packages are available for use in heating or cooking foods in an oven, including a conventional electric or gas oven, a convection oven or a microwave oven. A common feature of the disposable, heatable package is a venting means, which provides for the release of steam or any other gas that may be generated within the package. The tray covered by a film or a flexible pouch may be used as a disposable container for both storing and cooking the food product contained therein. Advantageously, the disposable container may be used in cooking a frozen food, or a food at room temperature.

Under some circumstances, it may be desirable to track the location of the package within the distribution chain. For example, the package may be tracked while at the manufacturing facility, at a warehouse facility, during shipping, or at a retail outlet or for any other purpose.

In the past, transmitters were applied to directly to the outside of the package or to a group of packages, by a machine or by an operator. However, this is not a reliable technique, since the tag is subject to loss or substitution. Thus, there is a need in the art for a package with an integrated tracking means, and a method and apparatus for making the same.

SUMMARY OF THE INVENTION

Accordingly, the present invention is a package with an integrated tracking means, and an apparatus and method for manufacturing the package with integrated tracking means. A flexible pouch includes a panel having an upper edge, an opposed lower edge and two side edges that form the flexible pouch. A tracking device is disposed within an air pocket formed in a sealed portion of the flexible pouch. An opening means is integrally formed in the panel for accessing a product contained within the pouch. In another embodiment, the package is a container having a base wall and a side wall extending upwardly from an edge of the base wall. A cover removable encloses the container, and a valve is disposed in the cover for venting a gas from the container. The tracking device is disposed within an enclosed air pocket integrally formed in a base wall or a side wall of the container.

The method of forming the flexible pouch includes the steps of forming a body of the pouch from a roll of laminate material. The method also includes the steps of locating a tracking means on the body of the pouch. The method further includes the steps of sealing the lower edge, first side edge and second side edge using a seal means. The seal means includes a seal bar having a recessed portion for forming an enclosed cavity, and the recessed portion of the seal bar is positioned relative to the tracking device, so that the tracking device is disposed within an air pocket formed by the enclosed cavity. The method still further includes the steps of applying an opening means to the panel and finishing the pouch.

One advantage of the present invention is that a disposable package is provided that includes an integrated radio frequency identification tracking device. Another advantage of the present invention is that the package with an integrated tracking device has improved signal reception. Still another advantage of the present invention is that individual packages may be tagged. A further advantage of the present invention is that the integral RFID tag is more reliable, and not subject to loss or substitution. Still a further advantage of the present invention is that an automated machine is provided for producing a flexible pouch with an integrated tracking device located in an air pocket formed in a sealed area of a wall of the pouch. Yet still a further advantage of the present invention is that an improved process of manufacturing a flexible pouch with an integrated tracking means is provided that is more cost effective, since the tracking means is applied during the pouch manufacturing operation in a more reliable manner. A further advantage of the present invention is that a sealed tray is provided with an integrated radio frequency tracking device.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Referring to FIGS. 1-6 a package having an integrated tracking means is illustrated, and in particular a flexible pouch 10 with an integrated tracking means. In this example, the pouch 10 is a flexible stand-up pouch. The pouch 10 is filled with a product 90 and sealed. Various shapes are contemplated for the pouch. For example, the pouch 10 may have a generally rectangular shape, cylindrical shape, a box-like shape, an hourglass shape, or another shape. It is contemplated that the pouch may contain a single portion or multiple portions of the product. The type of product is unlimited, and could have a solid or a liquid or gaseous form.

Figure 1:
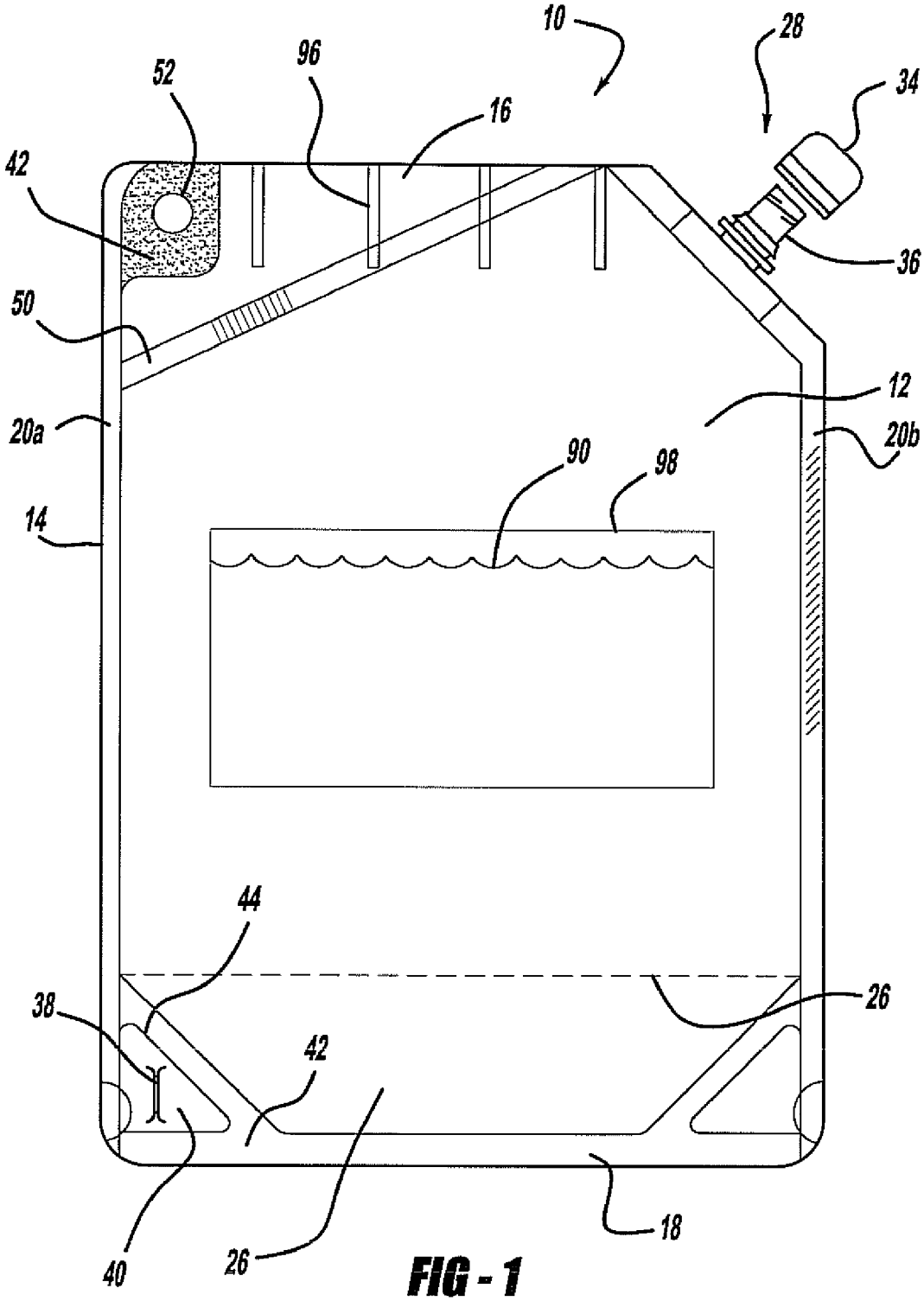
FIG. 1 is an elevational view of a flexible pouch with an integrated tracking means, according to the present invention.

The flexible pouch 10 is preferably formed from a roll of preprinted material of extruded or laminate layers. The material is typically a three, or four or five or more gauge material, or two laminations of material or the like. One layer may be extruded. The outer layer is usually preprinted. Alternatively, at least a portion of the material may be not printed, i.e. translucent, in order to view the product 90 contained therein, as shown in FIG. 1 at 58 as a window. The clear portion 58 could also be in a gusset or insert. The outer layer of material may be a sleeve or label 54 with preprinted information.

The choice of sheet layer material is non-limiting, and is influenced by factors such as the product contained in the pouch, the shape of the pouch, or the anticipated use of the pouch. One example of a laminate material structure includes at least one layer of virgin polyethylene terephthalate (PET), at least one layer of aluminum foil and another layer such as EVOH, PET, polyethylene or nylon or the like. Another type of laminate material structure may also include a metalized foil paper layer laminated to a cast polypropylene layer and another layer of PET, polyethylene or EVOH. There may be a fourth layer of nylon. Similarly, the laminate structure may include a cast polypropylene (CPP) layer, a polyethylene (PET) layer, a foil (AL) layer, a nylon (ONO) layer and another CPP layer. Another structure is the use of nylon, foil, nylon and cast polypropylene (ONO/AL/ONO/CPP) or CPP/NY/AL/CPP. Another example of a material structure is ONO/AL/COEX-ONO-LDPE. Still another is PET/AL/NYLON/CPP. Material structures that include CPP are well suited for packaging a carbonated product or a product having an alcoholic content, such as wine or beer or another liquor, to add strength to the walls of the pouch, and to preserve the product. CPP and nylon protect the AL layer from cracking. Carbonation is beneficial since it acts as a microbiocide and preserves the flavor and aroma of certain types of products. The use of cast polypropylene laminate material also assists in retaining the filled shape of the container, even as the product is removed from the pouch 10. A further example of a laminate material structure is CPP/AL/ONO/PE. This structure works well when the product has a short shelf life, and the nylon eliminates stretching or cracking of the AL layer. An example of a material structure for a white wine product is PET/EVOH/PE or AL/PET/NY/PE. Similarly, a material structure for a red wine product includes PET/EVOH/PE, or AL/NY/PET/PE. Other film structures may also be utilized that offer similar protection from sunlight, as well as organoleptic protection from the development of undesirable flavors.

It should be appreciated that if the pouch is filled with certain types of products, such as a carbonated product, and stored at ambient temperature, the laminate will start to creep after a period of time, such as ten days. The laminate material may include an extrusion layer to contain "creepage" or "stretch" of the film after filling due to carbonation expansion of the carbonated product. In addition, the selected material may be organoleptic compliant in order to avoid the transfer of odor contaminates to the product, or product contamination during the shelf life period of the product.

Figure 6A:
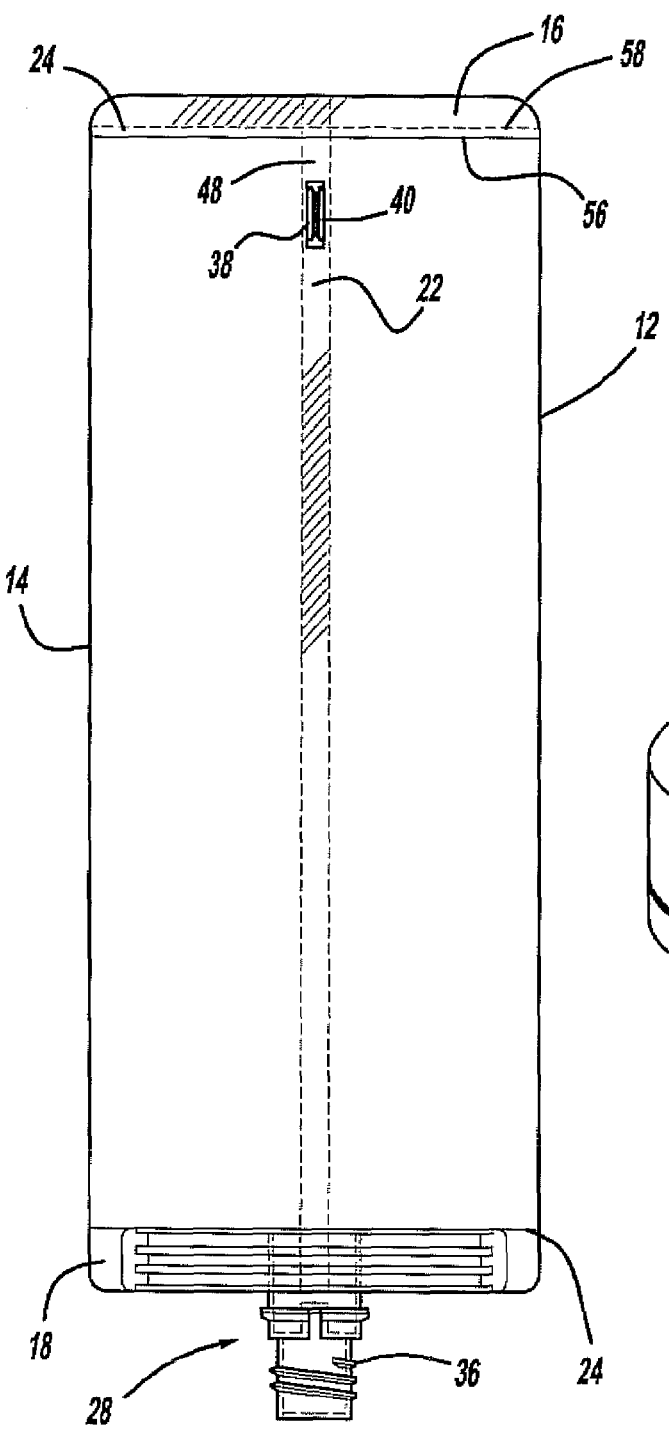
FIG. 6*a* is an elevational view of a flexible pouch with an integrated tracking means in a side seam, according to the present invention.

The pouch 10 is formed from at least one panel of material. The panel has an inner surface that is adjacent the product, and an outer surface. The pouch formed out of the panel has a front wall 12 and a back wall 14. Each wall 12, 14 is further defined by an upper edge 16, an opposed lower edge 18, and first and second side edges 20*a*, 20*b* extending therebetween the upper and lower edges 16, 18. The side edges 20*a*, 20*b* of the panel form a sealed seam. It is appreciated that the figures teach that the seam extends to a peripheral edge of the panel. The pouch may include two side seams if made from two panels or one single seam if made from one panel. In an example of a pouch formed using a single panel of material, the side edges 20*a*, 20*b* may be joined along a center seam, as shown in FIG. 6*a* at 22. The seam may be a flat seam. In an example of a pouch 10 formed using two panels of material, the edges are joined along two side seams. Again, the side seam may be a flat seam. An example of a pouch with a flat seam is disclosed in commonly assigned U.S. patent application Ser. No. 11/551,071, which is incorporated herein by reference.

The pouch 10 may include an insert 24, sidewall or gusset 26. The gusset 26 may be integrally formed in the panel by folding the panel, or a separate piece of material disposed between the walls. For example, the gusset 26 may be disposed between the front and back walls 12, 14, and positioned between the side edges of the walls, the lower edges, the upper edges, or any desired combination. It should be appreciated that the shape of the gusset 26 is non-limiting. For example, the gusset 26 may be generally wider at one end and taper upwardly towards the opposite end. The gusset 26 may also be of a uniform width. The use of the gusset 26 may be functional, i.e. it may allow the pouch 10 to acquire another shape, such as cylindrical, or to stand upright. The gusset 26 also enhances the strength and rigidity of the pouch 10 during filling and processing. A side gusset is advantageous since it allows the walls of the pouch to expand as the internal pressure within the pouch increases. A gusset 26 positioned between the lower edges 18 of the pouch 10 may form a base, enabling the pouch 10 to stand upright unsupported.

Figure 6B:
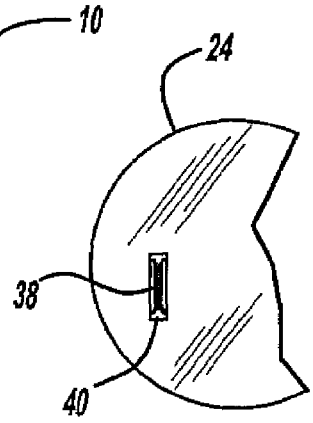
FIG. 6*b* is an elevational view of an insert with an integrated tracking means for the flexible pouch of FIG. 6*a*, according to the present invention.
Figure 6C:
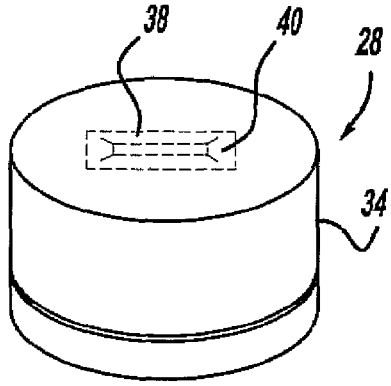
FIG. 6*c* is an elevational view of a cap with an integrated tracking means for the flexible pouch of FIG. 6*a*, according to the present invention.
Figure 6D:
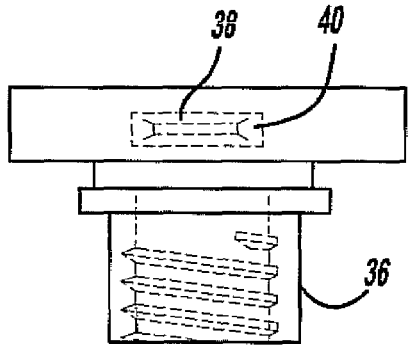
FIG. 6*d* is an elevational view of a fitment with an integrated tracking means for the flexible pouch of FIG. 6*a*, according to the present invention.

Similarly, the pouch may include an insert, as shown in FIG. 6*b*. The insert 24 is a generally planar member that is inserted between the walls 12, 14 of the pouch 10. The shape of the insert 24 is non-limiting, i.e. square, round or oval or rectangular, and generally influences the shape of the flexible pouch. The insert 24 may be positioned internally within the pouch or externally. Various materials may be utilized for the insert, such as foil, cardboard, plastic, nylon, laminate or the like. Further, the insert 24 may be formed from a printed material, or it may be clear. In one example, the insert 24 is inserted between the lower edges of the panel and sealed to the walls of the panel. The seal may be an ultrasonic seal or a heat weld or a combination of both or the like. The pouch may contain two inserts as shown in FIG. 6*a*. In this example, there is a first insert positioned between the lower edges 18 of the panel, and a second insert positioned between the upper edges 16 of the panel. The first insert may include an integral opening means, such as a fitment. The pouch of this example has a generally cylindrical shape.

Figure 4:
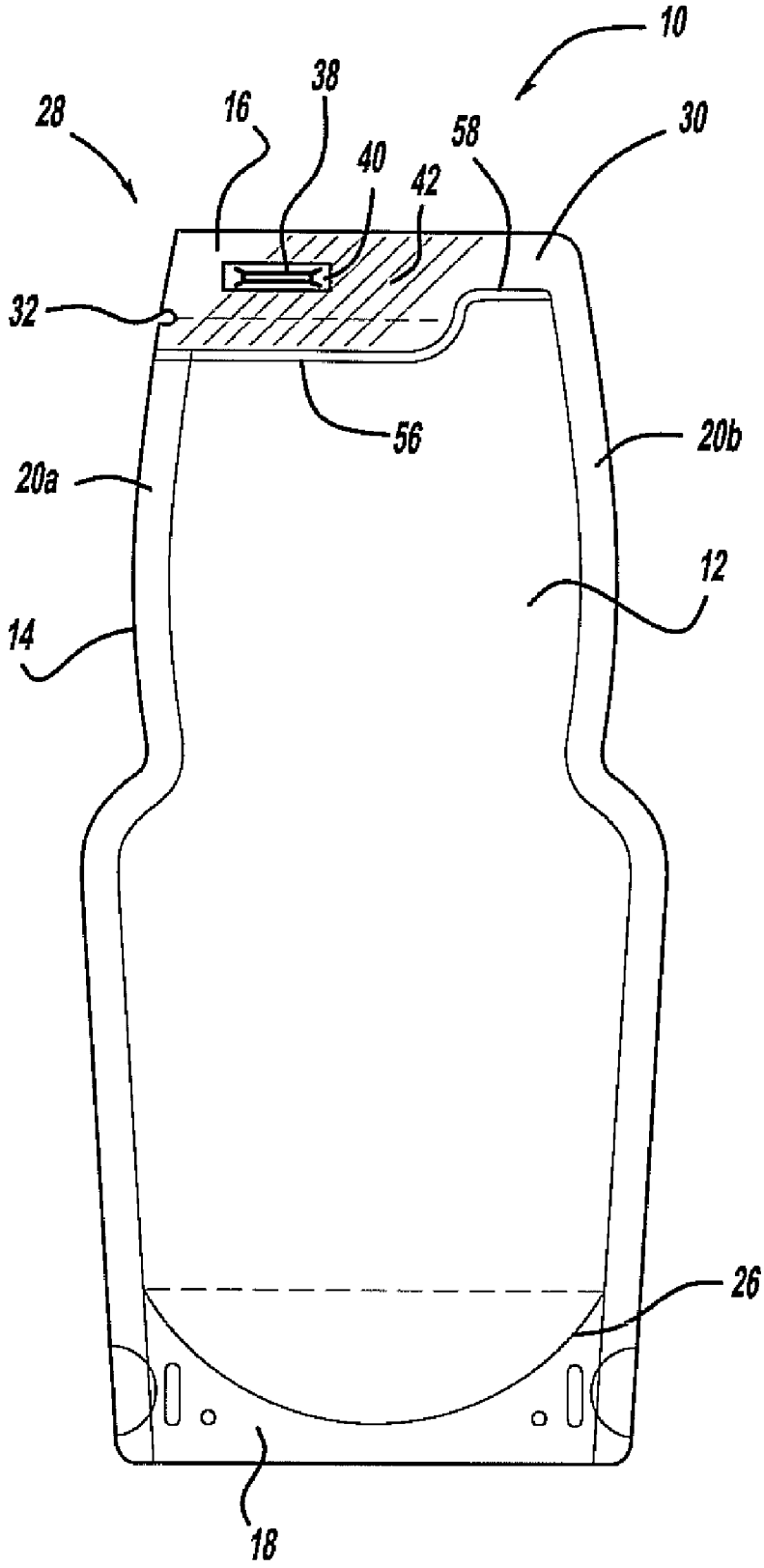
FIG. 4 is an elevational view of still another example of a flexible pouch with an integrated tracking means, according to the present invention.
Figure 5:
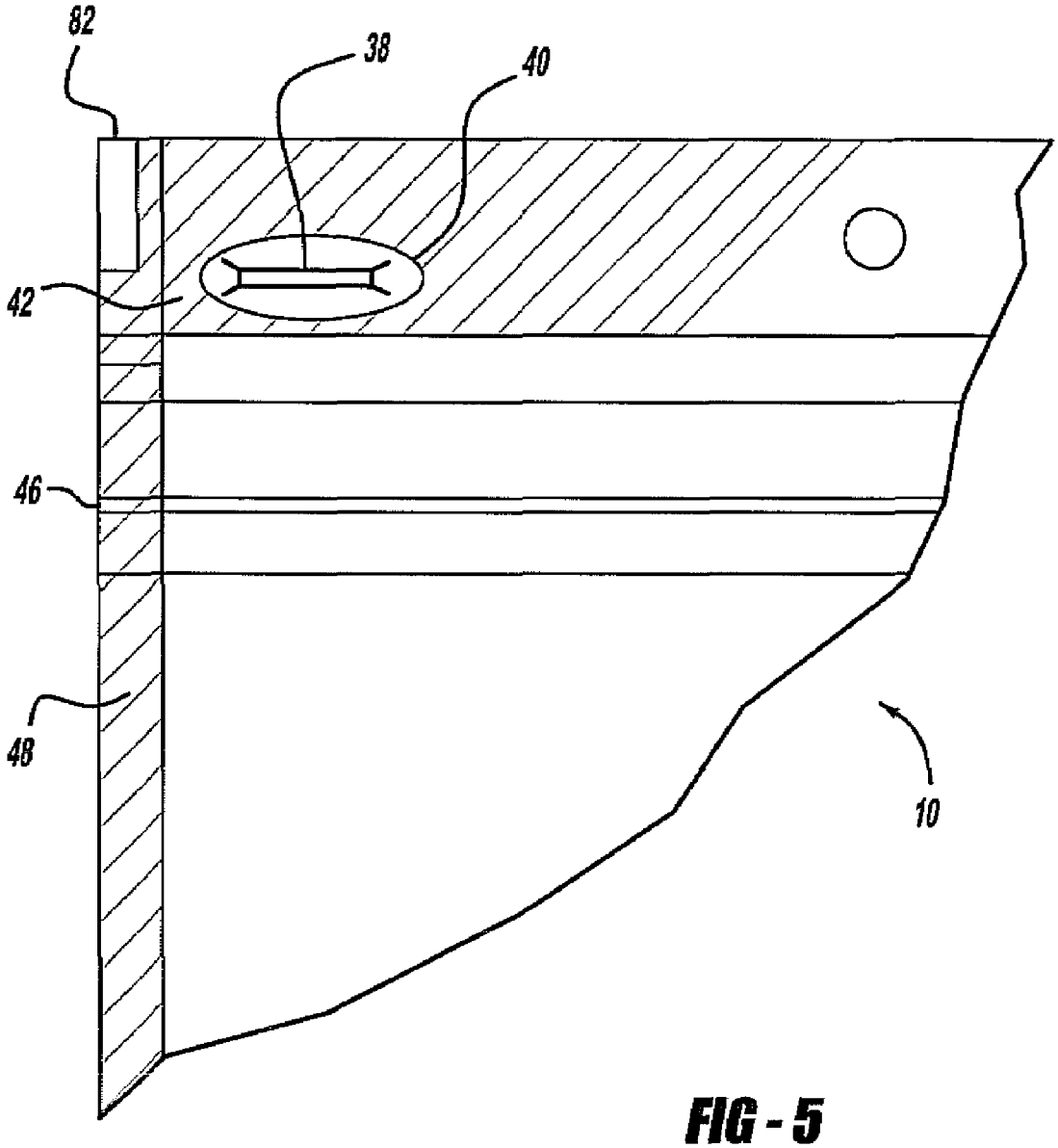
FIG. 5 is a partial view of a flexible pouch with an integrated tracking means and a zipper opening means, according to the present invention.

The pouch 10 incorporates an opening means 28 for accessing the contents of the pouch. Various types of opening means 28 are known in the art for this purpose, and is non-limiting. It should be appreciated that the opening means 28 may be incorporated into the pouch 10 prior to filling the pouch 10. One example of an opening means is a tear-off portion 30, as shown in FIG. 4. The tear-off portion 30 usually has an integral tear notch 32. The tear notch 32 is typically formed near an outermost edge of a seam, for initiating the removal of the tear-off portion, such as a side edge. A further example of an opening means 28 is a pull tab covering an opening in the pouch. As shown in FIG. 5, yet another example of an opening means 28 is a resealable zipper 46, which provides a hermetic seal. Another example of an opening means 28 is a weakened straw pierceable portion in the pouch for receiving a straw.

Still a further example of an opening means 28 is a fitment such as a removable and replaceable cap 34 secured to a spout 36, or a tap, or the like. Various types of caps and spouts are available. For example, the cap 34 can be the traditional round shape, or have an elongated oval shape. An oval shape may support the pouch is that it can stand up on its own. The cap 34 and spout 36 can be made from a variety of materials. For example, the cap 34 may be made from plastic, such as reground resins. The spout may be made of polypropylene (PP), depending on the product. The spout is sealed into the upper edges of the panel using a sealing means, such as an ultrasonic seal or a heat weld, or the like. The spout may include a removable seal to prevent leakage of the product or evidence of tampering.

The pouch includes a tracking device 38 integrally located within the pouch 10 that includes electronic tracking information relevant to the pouch 10. For example, the tracking device 38 may be secured within an airspace or air pocket 40 formed in a sealed portion 42 of the pouch 10. Preferably, the tracking device 38 is integrally located within the pouch 10 during the manufacturing process. In this example, the tracking device 38 is an electronic tag, such as a Radio Frequency Identification (REID) transmitter. The signal from the RFID transmitter 38 is received by a remotely located receiver, allowing the location of the pouch 10 to be tracked. An example of an RFID transmitter 38 is an antenna. The antenna may be printed. In another example, the tracking device 38 may be embedded in a synthetic, optically clear, food grade, high temperature and low temperature adhesive label. In still another example, the printed antenna may be inlayed onto the label. In a further example, a chip may be mounted on the label in a similar manner. A chip may be used for UHF or HF frequencies, and is also referred to as a transponder. The chip may be available in a continuous roll form, either as dry or wet, and include an adhesive. The process of applying the chip to the roll includes the steps of printing the antenna and mounting the chip to the roll.

The tracking device 38 can store a predetermined amount of electronic information. An example of the information is unique tracking information for a particular package 10. For example, the tracking device 38 can provide information about the status of the pouch 10, such as physical location of the pouch 10, or age of the pouch 10 or the like. In addition, the tracking device 38 can be utilized for inventory control, delivery, purchase behavior, returns, pricing, and other tracking purposes. The tracking device 38 is in communication with a receiver (not shown) for reading the information. The receiver may be a computer system having a memory and a processor, a handheld device for receiving an RFID signal, or any other type of device capable of electronic communication with the tracking device 38. The receiver may be a transceiver capable of emitting a radio signal that initiates transmission of information from the tracking device 38. Although the packages are individually read, the RFID tag may be advantageously read at a faster rate than using a barcode in conjunction with a barcode scanner, since the packages are not physically scanned on an individual basis. In addition, the signal from the RFID tag may be advantageously read through an outer layer of material, such as a packaging material, or under various environmental conditions. Another advantage is that the tracking of the physical location of the package may be electronically monitored within a predetermined geographical range.

Figure 2:
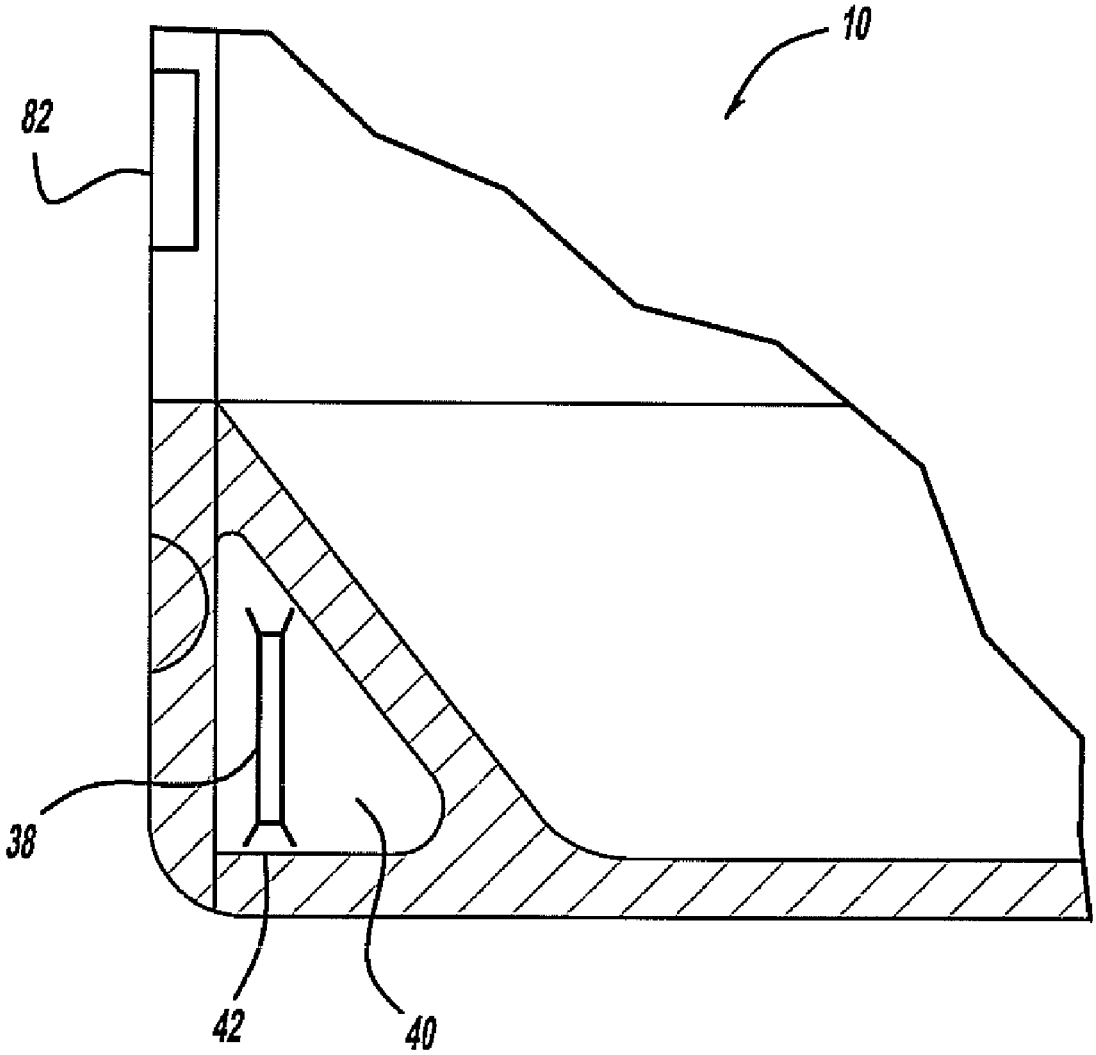
FIG. 2 is a partial view of the flexible pouch of FIG. 1 with an integrated tracking means, according to the present invention.
Figure 3:
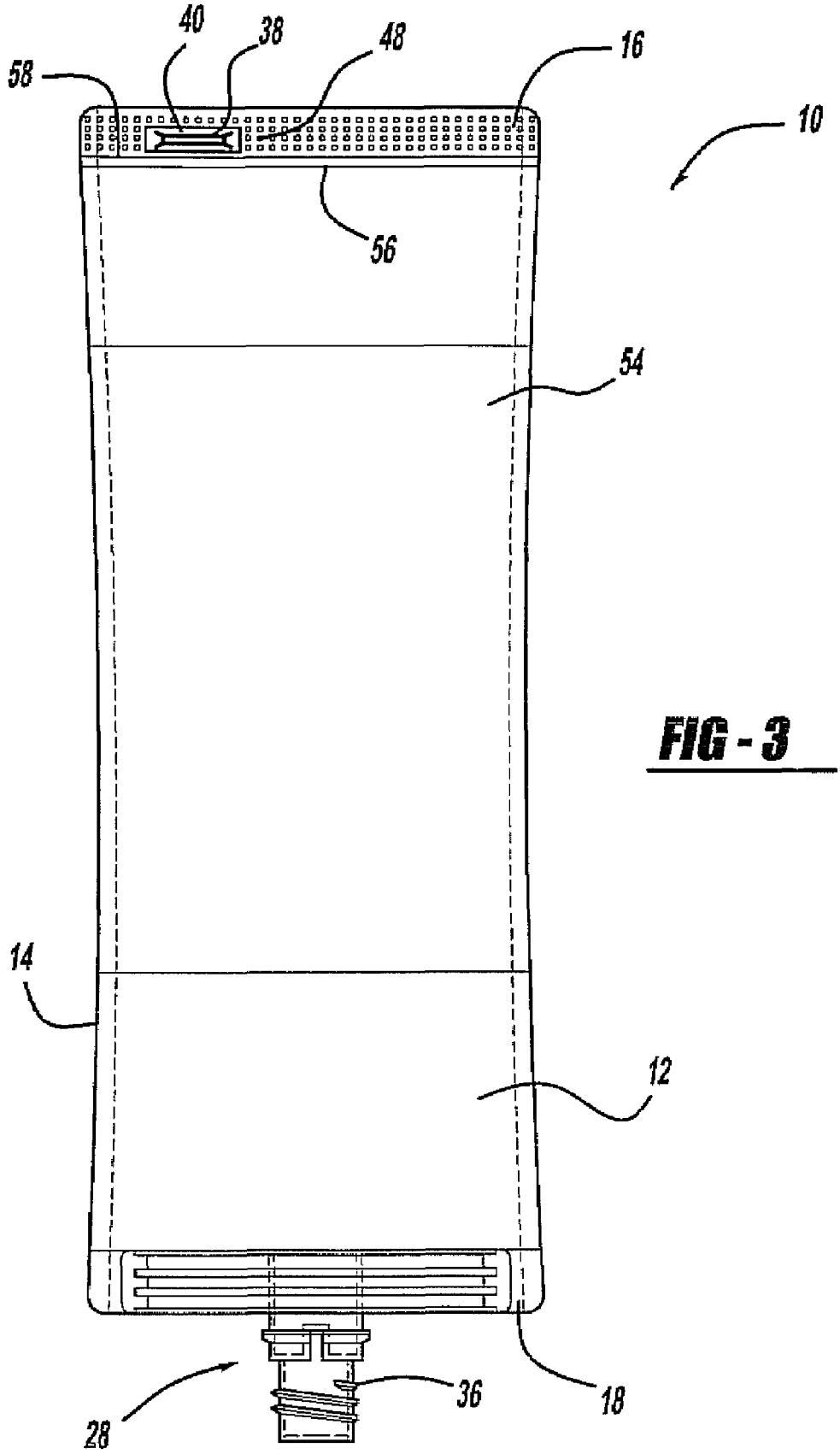
FIG. 3 is an elevational view of another example of a flexible pouch with an integrated tracking means, according to the present invention.

The tracking device 38 is integrally embedded in the pouch 10. In the example of a pouch 10 with a gusset 26, a plurality of apertures 44 may be punched in the folded area of the gusset 26 to reduce the amount of material in the gusset 26. The tracking device 38 may be inserted in an air pocket 40 formed within one of the gusset apertures 44. The inclusion of the tracking device 38 in the air pocket 40 is advantageous because it improves the signal strength of the tracking device 38. Alternatively, the tracking device 38 may be inserted in a sealed portion 42 of the pouch 10, and an air pocket 40 is formed around the tracking device 38 during application of the seal. In FIG. 3, the tracking device 38 is disposed in an air pocket 40 formed in a sealed portion or seam 48 along the upper edge 16. In FIGS. 1 and 2 the tracking device is in an air pocket 40 formed in a gusseted portion along the lower edge. The tracking device 38 is protected from theft and substitution or loss, since it is sealed in the air pocket 40. In another example shown in FIG. 6*c*, the tracking device 38 is integrally formed in the opening means 28. For example, the tracking device 38 is located in an air pocket 40 formed in the spout. In another example, the tracking device 38 is embedded in an air pocket 40 formed in the fitment or cap 34. In still another example the tracking device is located in an air pocket 40 formed in the zipper 46. In a further example, the tracking device is embedded in an air pocket 40 formed in the insert 24.

The pouch 10 may include features such as an angled top seal 50 extending between a first side edge 20*a* and a predetermined location on the upper edge 16 of the pouch. The angled top seal 50 facilitates the removal of product from the pouch 10 by directing the flow of the product towards the opening means. An example of such a pouch is disclosed in commonly assigned U.S. patent application Ser. No. 11/683,133 which is incorporated herein by reference.

The pouch 10 may include a feature such as a hanging aperture 52 located within an edge, such as an upper edge or side edge. The aperture 52 may have various shapes, such as round or curved. The pouch 10 may be supported by a support means, such as a hook that extends through the aperture 52. The pouch 10 may be hung for display or storage purposes. The positioning of the hanging aperture 52 above the angled top seal 50 or within a sealed portion 42 prevents the contents of the pouch from leaking out through the aperture 52.

It should be appreciated that the flexible pouch 10 may advantageously include other features that are known in the art. An example of a feature is a dimple (not shown) for receiving a straw. Another feature is a weakened portion adjacent the opening means, to facilitate opening the pouch. Still another feature is a straw (not shown) attached to the pouch 10. In still another example, the flexible pouch 10 may include a guide pocket formed in a wall 14, 16 of the pouch 10 prior to filling and sealing, to facilitate the separation of the front and back walls 14, 16 prior to the filling of the pouch 10. An example of such a pouch is disclosed in commonly assigned U.S. patent application Ser. No. 10/310,221. In a further example, the pouch may contain a rib 56 that adds strength or support or form to the pouch. The rib 56 may be thermoformed.

The pouch may include a feature such as an ergonomic shape. An example of an ergonomically shaped pouch for a carbonated beverage is disclosed in commonly assigned U.S. patent application Ser. No. 11/454,241 which is incorporated by reference. The ergonomic shape may be achieved through carbonation as the pouch 10 is filled with a carbonated product, since the carbonation causes the pressure within the pouch to increase. The increased pressure causes the front wall 12 and back wall 14 to assume a longitudinally oriented convex shape, and each side edge 20*a*, 20*b* assumes a longitudinally oriented concave shape. Thus, the width across the pouch is less in the middle, than at the upper edge or lower edge. The overall hourglass shape assumed by the pouch 10 due to the internal pressure within the pouch facilitates holding of the pouch in the hand of a user.

The flexible pouch 10 may include a feature such as an outer layer or sleeve 54 covering the outer surface of the pouch. The sleeve 54 may be a label containing information about the product, such as a barcode or the like. The sleeve 54 may cover only a portion of the pouch outer surface. Preferably, the sleeve 54 is shrunk over the outer surface of the pouch 10 after the pouch 10 is formed and filled with the product. The sleeve 54 is advantageous because it covers the side seam. It also adds one or more layers of material to strengthen the pouch and improve its durability. Various types of material may be utilized for the sleeve, such as paper or plastic including PET or PVC and the choice is non-limiting.

The pouch 10 may include a feature as a result of a secondary process after it is filled with the product. For example, the filled pouch 10 may be frozen. Alternatively, the filled pouch 10 may be pasteurized in order to have an extended shelf stable life under ambient temperature.

It is contemplated that the flexible pouch 10 may incorporate any of the above-described features in any combination. For example, the pouch 10 may include an insert 24 in the bottom portion of the pouch and a tapered top portion, or an insert 24 in the bottom portion of the pouch and a spout 36 and cap 34 in the top portion of the pouch. In addition, the finished pouch may assume various shapes, such as cylindrical, cubical, and conical, hourglass or the like, as influenced by the type of product and intended usage of the pouch. It should further be appreciated that the upper edge and lower edge may be interchangeable and is merely for reference purposes.

Figure 7:
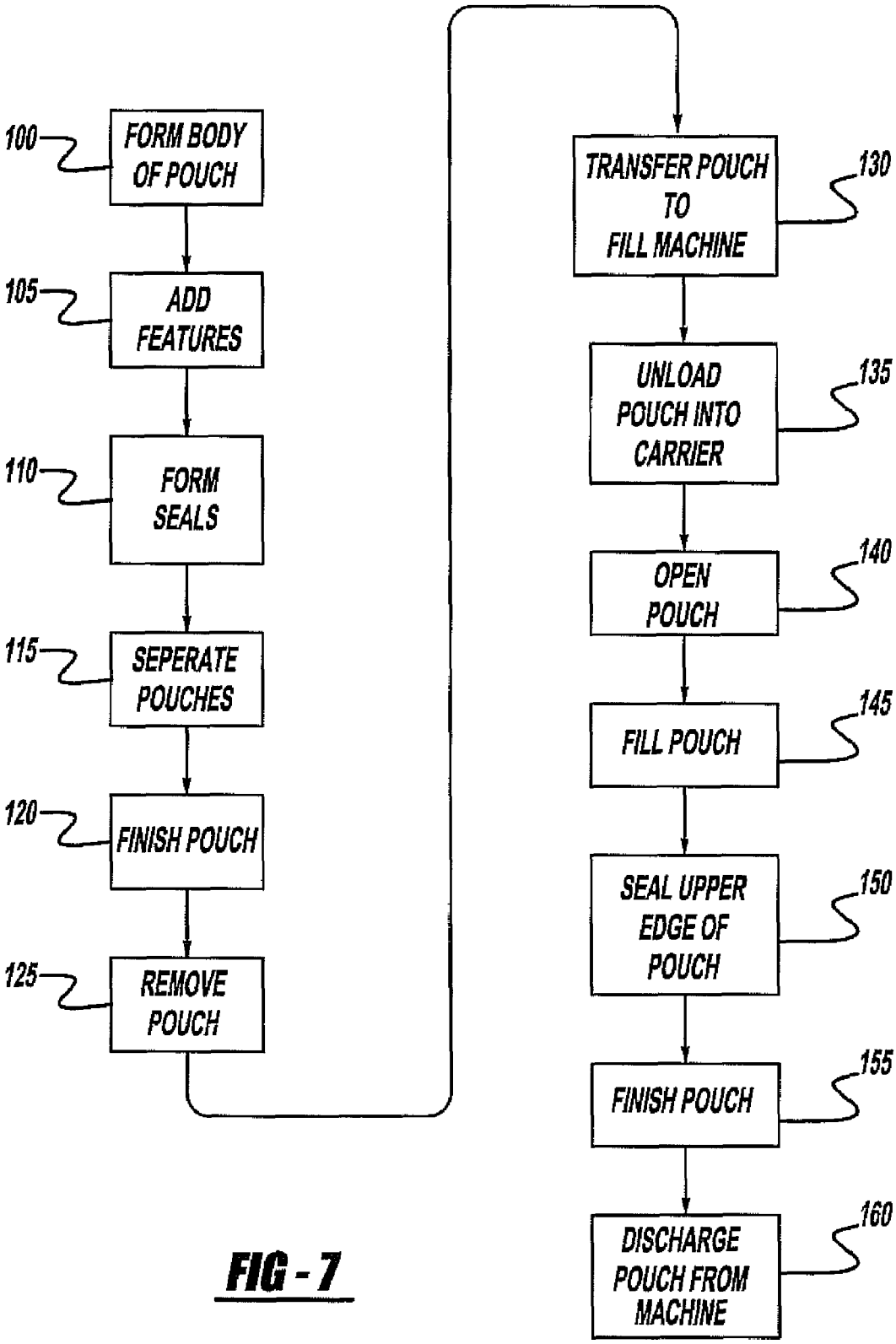
FIG. 7 is a method of making a flexible pouch with an integrated tracking means, according to the present invention.
Figure 9:
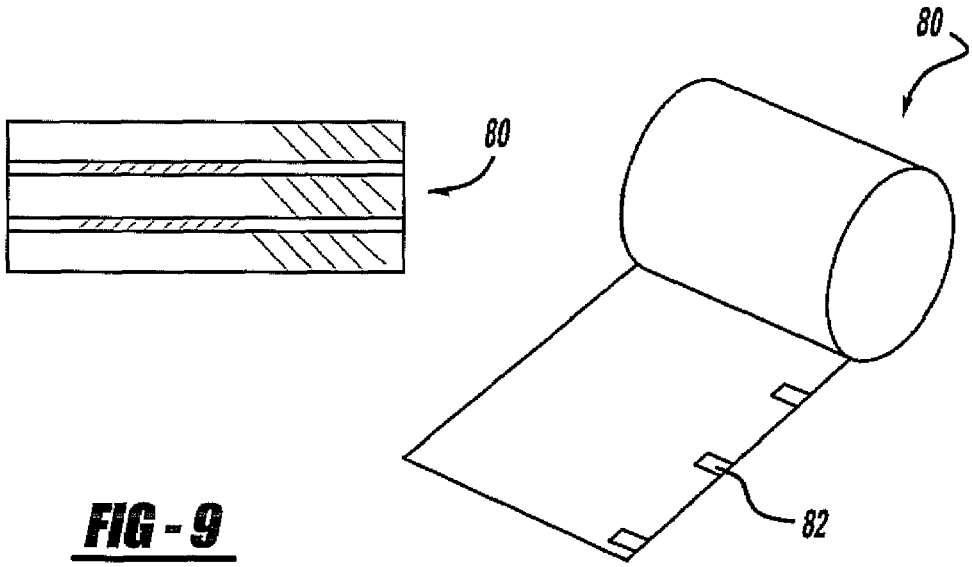
FIG. 9 is a diagrammatic view of a material for the flexible pouch, according to the present invention.

Referring to FIG. 7, a method for manufacturing a flexible pouch is illustrated. An example of a high speed, multiple lane machine for forming a pouch is described in commonly assigned U.S. patent application Ser. No. 11/674,923, which is incorporated herein by reference. An example of a pouch forming machine is the Nishibe model number SBM500, SMB600 or SMB700. The method begins in block 100 with the step of forming the body of the pouch. Each pouch 10 has a predetermined shape, which in this example is a rectangle. The body of the pouch is formed from a roll of a preprinted laminate material, as shown in FIG. 9 at 80, as previously described. In this example, the laminate material contains three layers.

Figure 10:
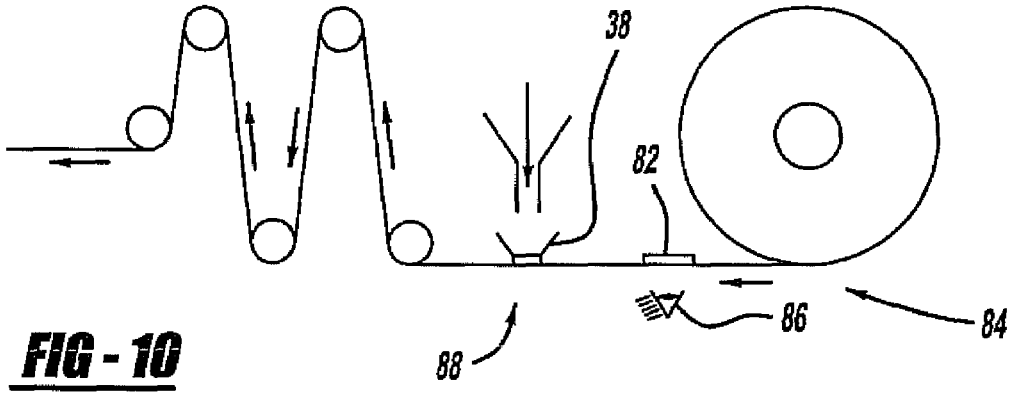
FIG. 10 is a diagrammatic view of a portion of an automated machine for manufacturing the flexible pouch, according to the present invention.

For example, a roll of laminate material is unrolled along a horizontally oriented plane as shown at 84 of FIG. 10. The initial width of the roll of material is determined by the desired finished size of the pouch 10 and the number of pouches to be obtained from the width. For example, three or four or six pouches, representing six to twelve panels, can be obtained from a width of the roll of material on a three-lane machine or four-lane machine, respectively. Each panel has an inner surface and an outer surface. One layer of the material may be preprinted with information or locating indicia 82, such as a registration mark. The registration marks 82 are located on the material to denote an edge of the panel. The registration marks 82 are read by an optical reading device 86, such as a scanner or registration eye, to index the material in a predetermined position at the cutting station. The preprinted information may include labeling information that describes the product contained within the pouch. In this example, the layer of preprinted information is located on an outer layer of the material. One layer of the material may also be preprinted with a tracking device 38, such as the RFID transmitter previously described. Alternatively, the RFID transmitter may be secured on the material as shown at 88, so that it is located in an air pocket when the pouch is formed at a later step. The methodology advances to block 105.

In block 105, a feature is optionally positioned between the unrolling sheets of material. An example of a feature is a vent valve inserted into one of the panels, such as the front panel. The valve provides for the venting of gas formed in the pouch, such as by heating or cooling. An example of such a value is disclosed in commonly assigned U.S. patent application Ser. No. 10/967,547, which is incorporated by reference. The valve is preferably placed in an upper corner of the pouch. Various techniques are contemplated for insertion of the valve. For example, a valve aperture may be cut into the panel, and the valve is inserted into the aperture in the panel. The valve is welded to the panel. Various processes are available, such as a heat weld or an ultrasonic seal, to obtain an airtight seal around the valve.

Other features are added to the pouch. For example, a gusset 26 may be inserted between the sidewalls of the pouch. Alternatively, the gusset 26 or pleat is formed in the panel using a folding operation to fold the panel. In one example, the folded pouch has a "V" shape to form the gusset 26. In another example, the folded pouch has a "W" shape. A plurality of apertures 44 are formed in the gusset 26, such as by using a punch. The plurality of apertures 44 are positioned in the gusseted portion of the material, so as to reduce the amount of material in the gusseted portion of the pouch for sealing purposes. The tracking device 38 is advantageously positioned in the air pocket 40 formed by the gusset aperture 44.

In another example of a pouch 10 with one seam, a fold may be formed along an edge in the sheet of material. An example of this type of pouch is disclosed in commonly assigned U.S. patent application Ser. No. 11/195,906 which is incorporated herein by reference.

An opening means may be included in this step. The opening means 28 may be located on the pouch 10 in a variety of locations, such as mounted on a bottom, or a top, or a side portion of the pouch. Various types of opening means 28 are contemplated, as previously described. For example, if a reclosable pouch is desired, a zipper 46, such that manufactured by Zip Tight may be inserted. This type of zipper is easily opened from the outside, however, it provides resistance to pressure on the inside, and the greater the pressure on the inside, the tighter the zipper is sealed. Another example is a spout fitment. In another example, an opening means such as a straw hole, patch or tear notch or spout may be applied. It should be appreciated that the cap or spout fitment may have a tracking device embedded therein. The methodology advances to block 110.

In block 110, the edges of the panel are sealed. It is contemplated that the side edges 20*a*, 20*b* may be sealed, a lower edge 18, or an upper edge 16, depending on the configuration of the pouch 10. Various techniques are known in the art for sealing the edges together.

Figure 11:
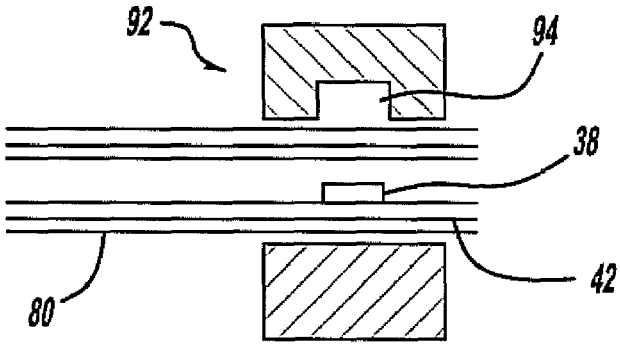
FIG. 11 is a diagrammatic view of a portion of a heat seal means for sealing the integrated tracking device in the flexible pouch, according to the present invention.

For example, the edges of the panel are sealed using a seal bar, as shown at 92 in FIG. 11. The seal bar 92 is a generally rectangular member conforming to the desired seal shape. The seal bar 92 includes a cavity 94 to create the air pocket 40 surrounding the tracking device 38. The tracking device 38 may be applied from a roll as shown, or may be integrally pre-formed in the material. Various sealing techniques are contemplated. For example, an ultrasonic sealing process may be used. Another technique is a heat weld that includes the application of heat and compression. The seal may be a heat weld process which includes the application of heat and compression in a two-step welding operation.

One edge may be left open for filling purposes. In this example, the open edge is designated the upper edge, for reference purposes. Alternatively, all of the edges are sealed and the pouch 10 is filled through a spout. Another seal, such as the angled top seal 50, may also be applied at this time. Advantageously, the seals may be shaped so as to avoid sharp radiuses at the interior corners of the pouch. A rounded interior shape facilitates removal of the product.

In still another example, the edges are sealed using a seal bar 92 or forming plate having a plasma coating. One advantage of the plasma coating is that the line speed may increase. Another advantage is that the coating makes the surface of the seal bar or forming plate more resilient. When the seal bar is heated, the coating expands due to this resiliency. The shear stress on the inner edge of the seal is reduced; resulting in reduced creepage of the material and greater durability of the seal. The plasma coating reduces the opportunity for potential damage to the material during the sealing step. In this example, the plasma coating is a smooth, hard plastic that mimics glass. Since the outer layer of material is not weakened, there is no creepage of the outer layer. This seal bar also includes the previously described seal bar recess for forming an air pocket for receiving the tracking device.

In still another example of a sealing technique, the side seal is a two-step seal formed using more than one seal bar. One seal bar may include the previously described seal bar cavity 94 for forming an air pocket 40 in the sealed portion 42, for receiving the tracking device 38. An example of a two-step seal is disclosed in commonly assigned U.S. patent application Ser. No. 11/551,071. The two-step seal advantageously avoids the generation of ketones due to application of heat to the material. The first or inner seal is a low temperature seal. The second or outer seal is a high temperature seal. The second seal is spaced apart from the first seal by a predetermined distance, to create an air gap. The first seal is a tack seal, such as 6 mm wide, and is of a sufficient temperature so as to melt the layers of material and tack the edges together. The predetermined distance between the first and second seal is ½-1 mm. The tracking device may be located within this sealed portion. The second seal is applied at a higher temperature and pressure than the first seal. As a result, any gas, such as steam, ketones, aromatics or the like are pushed in an outwardly direction, out through the open edges of the panels, and not into the pouch. Thus, the first seal prevents entry of contaminates into the pouch to avoid organoleptic contamination.

The methodology advances to block 115 and the pouches 10 are separated into individual pouches 10 along a cutting line. For example, each section of material may be first separated along its width, or the side seam of the pouches. The section is then separated into individual pouches 10. In this example, the width of unrolling material represents the side seams. The material is cut into a pouch 10 using a known cutting apparatus, such as a laser or punch or the like. The cutting apparatus forms a single cut in the material to separate the pouches. The size of the pouch 10 is controlled by the distance between the cuts.

Alternatively, two consecutive pouches 10 are separated using a double cutting process, whereby two cuts are made at the same time to separate the upper and lower edges of two pouches at the same time from the sheet of material. Advantageously, forming two pouches during the cutting operation effectively doubles the assembly line speed.

It should be appreciated that the upper edge or lower edge may be further trimmed. For example, the end of the pouch may be trimmed to accommodate a fitment. In another example, two legs are formed during the trimming operation, in order to recess the fitment.

A feature, such as an opening means 28, may also be applied to the pouch 10 at this time. For example, a spout fitment 36, as previously described, may be sealed within the walls of the pouch 10, such as between the upper edges 16. The spout fitment 36 may be sealed using an ultrasonic seal, or a heat weld, or by a combination of ultrasonic seal and heat weld. An example of an ultrasonic seal for a spout fitment is disclosed in commonly assigned U.S. patent application Ser. No. 11/195,906, which is incorporated herein by reference. Accordingly, the base portion of the fitment is sealed between the walls of the pouch using an ultrasonic seal, a heat seal, and then a cool seal. The heat seal melts a layer of the pouch material, and the material flows around the sealing ribs on the base portion, and fills in any void between the base portion and the wall of the pouch. The cool seal sets the seal and provides an attractive finish to the overall seal. Advantageously, fewer stations are required to seal the spout fitment between the walls of the pouch, since a tack seal is eliminated.

In addition, an insert 24 may be likewise applied to the pouch 10 at this time. The insert 24 may be positioned at a lower edge of the pouch, an upper edge, or both an upper and lower edge. The methodology advances to block 125.

In block 125, the individual pouches 10 are finished. For example, an outermost edge of the pouch 10 may be trimmed to shape, i.e. the corners may be angled or edges trimmed to accommodate a fitment. The pouch corners may be shaped to have a radius, to eliminate right angles at the corners. A hanging aperture 52, if present, may be formed at this time. This operation may be performed using a cutter or a die cut or the like. In addition, a tear notch 32 may be cut out of an outermost edge of the pouch to facilitate opening of the pouch.

In another example of a finishing operation, a crease or guide pocket may be formed in a top portion of each wail 12, 14 in a creasing operation, in order to facilitate opening and filling of the pouch. An example of a method of forming a crease in a wall to facilitate opening the pouch is disclosed in commonly assigned U.S. patent application Ser. No. 10/310,221, which is incorporated herein by reference. It should be appreciated that the shape of the finished pouch is non-limiting, and may be round, square, oval, triangular or the like. In still another example of a finishing operation, the sleeve 54 is applied over the individual pouch and shrunk to fit using an application of heat to the pouch. In a further example of a finishing operation, a rib 56 may be added to the pouch. The rib 56 may be thermoformed, and may provide the pouch 10 with shape or structure.

The methodology advances to block 130 and the pre-made pouch 10 is discharged from the form machine. The pouches may be loaded into a carrier and transferred to a filling machine. It should be appreciated that the filling machine may be integral with the pouch forming machine, or a separate machine. This portability increases the flexibility of the pouch and may result in a manufacturing cost savings.

The methodology advances to block 135, and the pouch 10 is then transported to the filling machine, is unloaded from the carrier, and placed in a holder for moving the pouch between stations. An example of a holder is a cup-shaped member, as disclosed in commonly assigned U.S. patent application Ser. No. 10/336,601, which is incorporated herein by reference. Alternatively, the pouch 10 may be held using grippers (not shown) as is known in the art. The methodology advances to block 140.

In block 140, the pouch 10 is opened in an opening operation. Various techniques are conventionally known in the art for opening the pouch 10. For example, the guide pocket formed by the crease in the front wall 12 and back wall 14 facilitates opening of the pouch. A nozzle (not shown) may be mechanically lowered into the guide pocket to direct a stream of compressed gas into the guide pocket, to force the walls of the pouch 10 away from each other. An example of a gas is carbon dioxide or nitrogen. The blowing station may include a manifold, with a hood extending over the top of the edges of the pouch as known in the art. The manifold has rows of apertures (not shown) formed above the upper edges 16 of the pouch 10. The hood is placed over the pouch 10 to assist in maintaining the air pressure in the pouch 10. The supply of pressurized gas is directed through the aperture to form a plurality of jets of pressurized gas or air. The jets are directed downwardly at the diamond-shaped openings formed at the upper edges 16 to assist in overcoming the surface tension of the pouch and assist in separation of the walls 12, 14. A diving rod (not shown) may then be used to make sure the pouch 10 is fully opened. If the pouch has a fitment, the gas is injected through the spout fitment. After the pouch is opened, it may be injected with super-saturated steam to eliminate any pathogens or the like. The methodology advances to block 145.

In block 145, the pouch 10 is filled with the product in a filling operation. For example, a fill tube (not shown) is lowered into the opened pouch 10 and the product is dispensed into the open pouch 10. The pouch may be filled through an open edge, or through the fitment, as previously described. If the pouch is large, the pouch may be filled at more than one station.

If the product is naturally carbonated, such as a sparkling wine or the like, the pouch is preferably filled while immersed in a nitrogen or carbon dioxide atmosphere. If the product is not naturally carbonated and carbonation is desirable, it is immersed in a carbonator to introduce carbon dioxide into the product. For example, carbon dioxide is introduced into cold water or juice to provide a carbonated beverage. The product may contain a mixture of up to four volumes of carbon dioxide. It should be appreciated that the carbon dioxide masks any undesirable taste from ketones and other solvents released during the sealing process. The carbon dioxide also increases the pressure within the product so that the walls of the pouch are rigid after the top is sealed. The product is preferably filled at a temperature ranging from 29° F. to ambient temperature.

The filled pouch may have the oxygen removed from the pouch. For example, the pouch may be flushed with carbon dioxide. The methodology advances to block 150.

In block 150, the pouch 10 is sealed. Various techniques are available for sealing the pouch 10. For example, a closing seal may be a heat weld, or an ultrasonic seal or ultra pulse seal. The seal technique depends on the product contained in the pouch, the pouch shape, or type of opening means or how the pouch is filled.

For example, if the pouch is filled through the open edges with a carbonated product, or product having an alcoholic content, the open edges of the pouch are closed by applying a first closing seal 56. The first closing seal 56 may be an ultrasonic seal, or an ultra pulse seal. An example of a closing seal for a pouch containing a carbonated beverage, is described in commonly owned PCT Patent Application No. PCT/US03/034396 which is incorporated herein by reference.

Alternatively, the pouch 10 is filled through the spout fitment 36 and the cap 34 is applied to close the pouch 10. The cap 34 contains the product in the filled pouch, to prevent leakage of the product from the pouch 10. The cap 34 may be a tamper-evident cap for a carbonated product. For a carbonated product, the complementary arrangement of threads and grooves in the cap and spout provides for the controlled release of pressure from the pouch, as disclosed in commonly assigned U.S. patent application Ser. No. 11/195,906, which is incorporated herein by reference.

In block 160, a second seal 58 may be applied a predetermined distance apart from the first seal 56. The second seal 58 may be a heat weld or a cosmetic seal or an ultrasonic seal or the like. For a carbonated product, the location of the second seal 58 is selected so that some of the product is trapped between the first and second seals 56, 58. This is advantageous since eliminates the potential for gas in the head space, i.e. the region between the product and the heat seal. In this example the second seal is spaced outboard of the first seal. Another advantage of the location of the second seal 58 is that the overall length of the pouch may be reduced, resulting in less pouch material. The first closing seal 56 is a tack seal, and the second closing seal 58 is a high pressure, high temperature seal. A cosmetic seal may applied with respect to the first and second closing seals, or the second seal 58 may be a cosmetic seal.

The methodology advances to block 155 and the pouch 10 is finished in a finishing operation. For example, the edges of the pouch 10 are trimmed to achieve a predetermined shape. In addition, the pouch 10 may be cooled at a cooling station, where the pouch 10 is cooled using a conventionally known cooling technique. Optionally, the sleeve 54 may be placed over the filled pouch and shrunk to fit over the pouch by applying heat. The sleeve layer forms an outer layer of the pouch. The methodology advances to block 160.

In block 160 the filled pouch 10 is discharged from the machine. A plurality of pouches may be placed in a package for sales or shipping purposes.

It should be appreciated that the pouch 10 may undergo other processing steps, such as such as an upstream oxygen purging station, downstream oxygen purging station, pasteurization or the like. For example, the filled pouch 10 may be pasteurized in integral retort chamber (not shown) that heats and then cools the pouch 10. The pouch 10 may be tested, such as burst testing or the like prior to packaging for shipping. These additional processing steps may take place at a station on the form/fill/seal apparatus, or on another apparatus.

It should be appreciated that the order of steps may vary depending on the pouch 10 and its features. Also, a particular manufacturing station may perform one or a plurality of operations, to enhance the efficiency of the methodology and apparatus.

It should be appreciated that the methodology may include other steps, such as an upstream oxygen purging station, a downstream oxygen purging station, or the like. In addition, a manufacturing station may perform one or a plurality of operations, to enhance the efficiency of the methodology and apparatus. It is also contemplated that the order of implementing the steps may vary to facilitate the manufacturing process.

Figure 8:
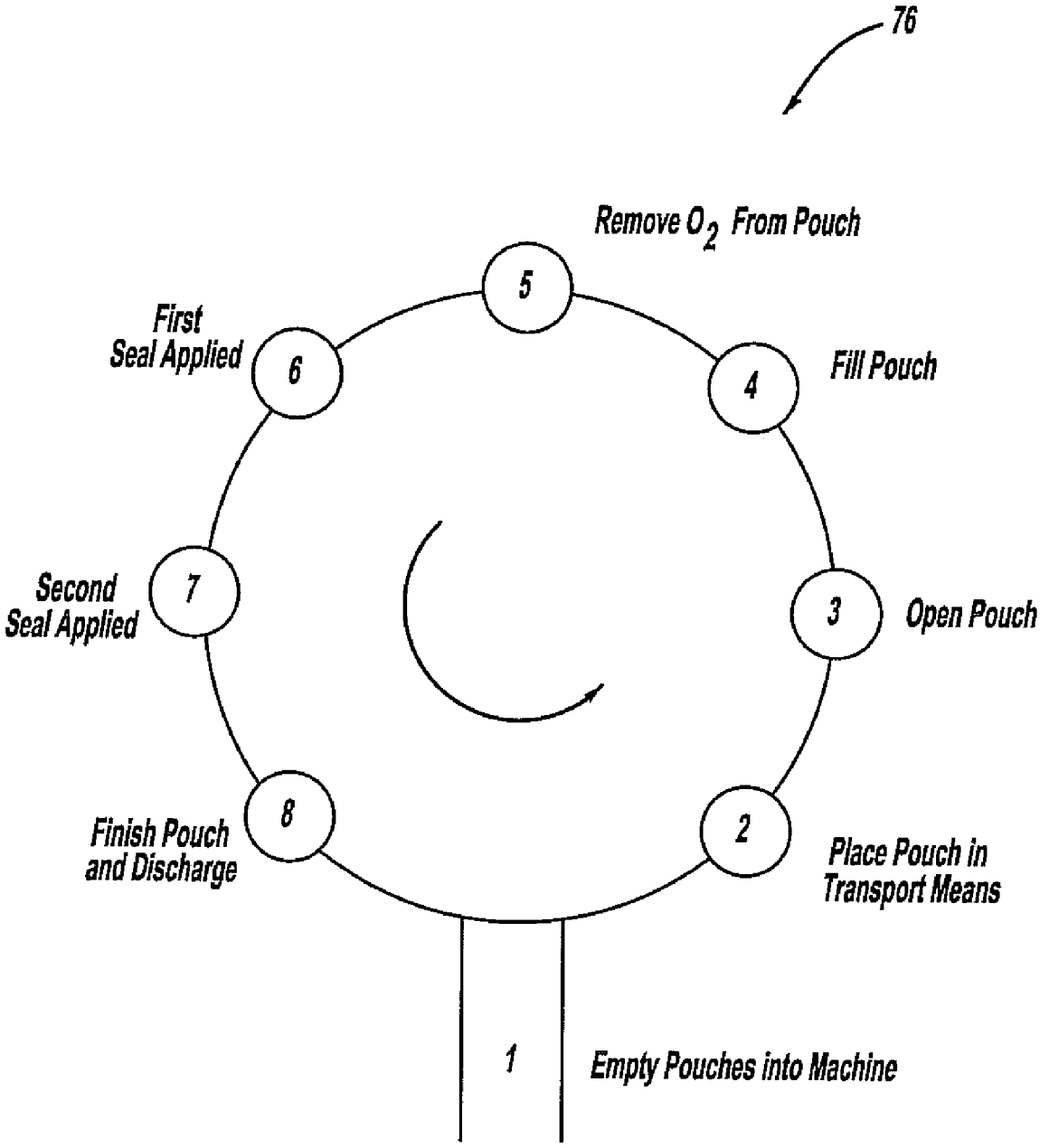
FIG. 8 is a diagrammatic view of an automated machine for manufacturing the flexible pouch, according to the present invention.

Referring to FIG. 8, an automated machine having operations for filling and sealing a flexible pouch is illustrated at 76. The fill machine illustrated is by way of example, and other configurations may be utilized. It should be appreciated that a particular manufacturing station may perform one or more operations. It should also be appreciated that the order of operations may vary. The fill-seal machine may be configured as a flat bed, a conveyor, a rotary turret or the like. An example of a flat bed form machine is manufactured by Nishibe, such as the model number SBM500, SMB600 or SMB700. It should be appreciated that the fill-seal machine may be integral with the form machine, or a separate machine.

In operation, the carrier with the pouch is loaded onto the machine 76 as shown at "1". The pouches 10 are removed from the receptacle and placed in a transport means as shown at "2". The transport means may be a carrier or a gripper or a combination of the two.

The pouch 10 is transported along the conveyor belt to operation "3", and the pouch 10 is opened in an opening operation. Various techniques are conventionally known in the art for further opening the pouch 10. The guide pocket formed by the crease in the front panel and back panel facilitates opening the upper edges of the pouch. For example, a nozzle may be mechanically lowered into the pouch to direct a stream of compressed gas downwardly into the pouch to force the walls of the pouch away from each other to further open an upper edge of the pouch. An example of a gas is carbon dioxide or nitrogen. The lever arms assist in maintaining the pouch in an open position.

The pouch 10 is then fully opened. For example, a blowing station may include a manifold, with a hood extending over the top of the edges of the pouch. The manifold has rows of apertures (not shown) formed above the upper edges of the walls of the pouch. The hood is placed over the pouch to assist in maintaining the air pressure in the pouch. The supply of pressurized gas is directed through the aperture to form a plurality of jets of pressurized gas or air. The jets are directed downwardly at the diamond-shaped openings formed at the upper edges to assist in overcoming the surface tension of the walls and assist in separation of the walls. A diving rod may then be used to make sure the pouch is fully opened.

The opened pouch is transferred to a filling station as indicated at operation "4", and the pouch is filled with the product. For example, a nozzle dispenses a predetermined amount of product into the opened pouch. The product may be dispensed into the opened edges of the pouch or through a fitment. In this example, the fill nozzle is lowered into the opened pouch, and the product is dispensed into the open pouch. Depending on the size of the pouch, there may be two fill stations.

If the product is naturally carbonated, such as with a sparkling wine or another alcoholic beverage, the pouch is preferably filled while immersed in a nitrogen atmosphere or carbon dioxide atmosphere. The pouch may be flushed with nitrogen or carbon dioxide or a mixture of both. If the product is not naturally carbonated, it may be immersed in a carbonator to introduce carbon dioxide into the product, if carbonation is desired. For example, carbon dioxide is introduced into cold water or juice to provide a carbonated beverage. The product may contain a mixture of up to four volumes of carbon dioxide. It should be appreciated that the carbon dioxide masks any undesirable taste from ketones and other solvents released during the sealing process. The carbon dioxide also increases the pressure within the product so that the walls of the pouch 10 are rigid after the top is sealed. The product is preferably filled at a temperature ranging from 29° F. to ambient temperature. The carbonation is advantageous as a microbiocide which can enhance the flavor or prevent mold or contamination.

The pouch 10 is transferred to a station "5" for removing any oxygen from the pouch. The headspace of the pouch may be flushed with a gas.

The pouch is then transferred to a sealing station and if filled through the open edges of the pouch, the open edges of the pouch are first sealed, as indicated at operation "6". For example, at the sealing station "6", the lifting surface ends, causing the lever arms to return to their original position and the pouch to close. It should be noted that the filled pouch might return to a partially closed position due to the product contained therein. The first seal may be a thermal seal. For example, a heat-sealing member extends through the slots in the sides of the cup to seal the upper edge of the pouch. As previously described, the heat sealing member may have a plasma coating. For example, a heat-sealing member extends therethrough the slots in the sides of the cup, to seal the upper edge of pouch. For example, at the sealing station "6", the lifting surface ends, causing the lever arms to return to their original position, and the pouch to close. It should be noted that the filled pouch might return to a partially closed position due to the product contained therein.

Another example of a first seal 56 for a product utilizes an ultrasonic sealing process. Preferably the ultrasonic seal includes sound waves and is formed using a horn and anvil. A second seal, if utilized, is applied at a second sealing station "7". The second seal 58 may be applied using a heat seal means to form a second heat seal spaced apart a predetermined distance from the first seal 56. It should be appreciated that the second seal 58 may be spaced slightly outboard of the first seal 56. The second heat-sealing station is conventional and utilizes heat or a combination of heat and pressure to form the seal. The second seal 58 may also be a cosmetic seal or another type of seal, such as ultrasonic, ultra pulse or the like. The first and second seals are applied for a carbonated product as disclosed in commonly assigned Patent Application No. PCT/US03/34396, which is incorporated herein by reference.

It should be appreciated that the tracking device may be located within an air pocket 40 in the sealed portion of the pouch.

If the pouch is filled through the fitment, the pouch is closed by securing a cap to the fitment. The cap may have a tamper-evident feature. In addition, the cap may contain a tracking device, as previously described.

The pouch is transferred to a finishing station as shown at "8" for finishing and removal from the filling machine. For example, the pasteurized pouch 10 may be cooled. A hanging aperture may be formed at this time. Similarly, a tear notch may be formed in the pouch to facilitate opening the pouch to access the product in the pouch. In another finishing operation, the edges of the pouch are trimmed to achieve a desired shape. The finished pouches may be discharged into a container. For example, grippers may be utilized to place the pouch in a box for shipment.

If desired, the pouch may be transferred to a pasteurization station. Pasteurization enhances the shelf life of the product. The pouch is inserted into an enclosed retort chamber. Air is extracted from the chamber, such as using a vacuum source. The product inside the pouch is pasteurized. For example, a combination of steam and water is used to heat the pouch to a predetermined temperature for a predetermined period of time to pasteurize the product contained within the pouch. The package is then cooled. In this example, recirculated water surrounds the pouch to cool the pouch. In certain instances, it may be desirable to apply steam to sterilize the pouch 10 and to wet the inner surface of the walls to facilitate handling.

It should be appreciated that the automated machine may include other operations. For example, the filled pouch may be transferred to another conveyor belt, or otherwise collected. Alternatively, other stations may include a straw pierceable opening station, an upstream oxygen purging station, downstream oxygen purging station, or the like. In addition, a manufacturing station may perform one or a plurality of operations, to enhance the efficiency of the methodology.

Figure 12:
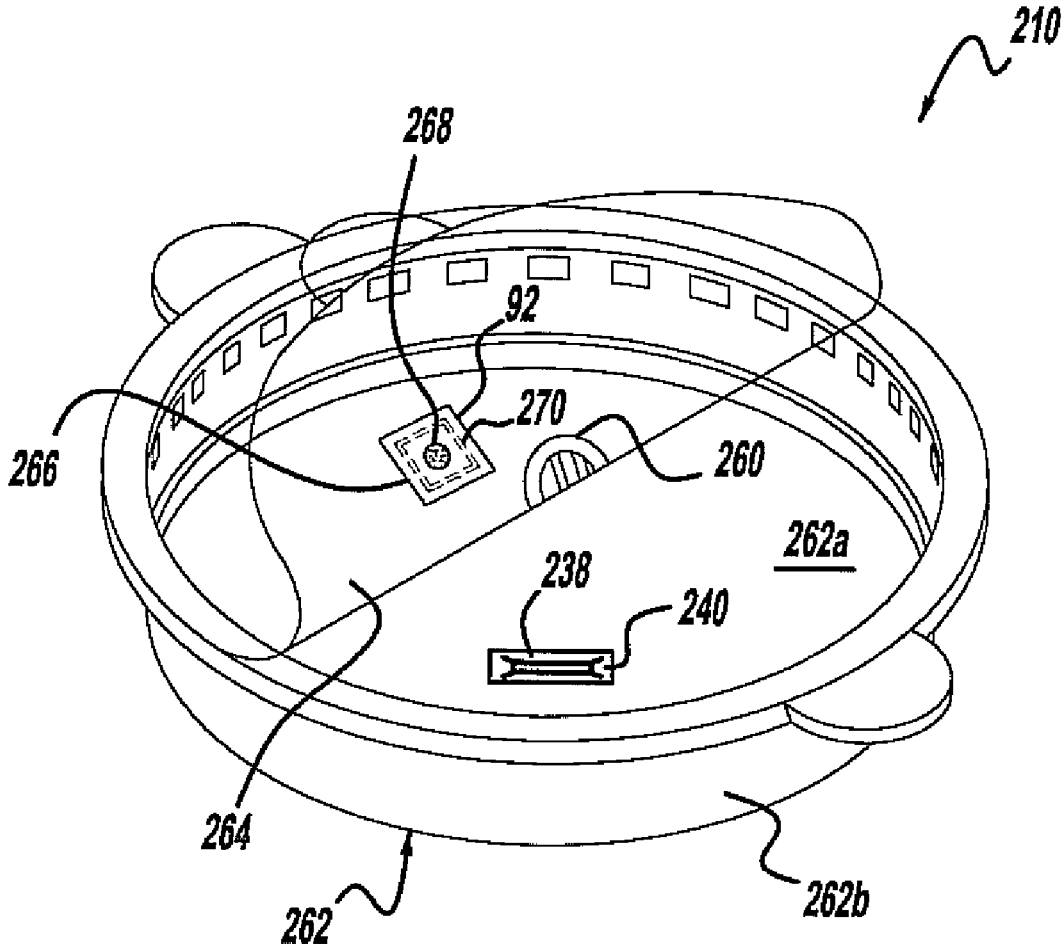
FIG. 12 is a perspective view of another embodiment of a package with an integrated tracking device, according to the present invention.

Referring to FIG. 12, another embodiment of a package 210 having an integral tracking device 238 is illustrated. It should be appreciated that like features have like reference numeral sin creased by 200. In addition, the package 210 may have a release valve assembly 260 incorporated into the package for the product. Typically, the package 210 includes a container 262 and a sealing film 264. An aperture is formed in the sealing film 264 for receiving the valve assembly. The valve assembly 260 is secured along the inner edge of the aperture in the sealing film 264 by heating, ultrasonic welding, or similar processes. The container 262 is filled with the product. The sealing film 264 is secured to the container 262 by heating sealing or any similar process. The package 210 is stored until ready for use. An example of such a package is disclosed in commonly assigned U.S. patent application Ser. Nos. 11/329,712 and 10/967,547, which are incorporated herein by reference. The container 262 includes a base wall 262*a* and a side wall 262*b* extending upwardly from the base wall 262*a*.

The container 262 includes a tracking device 238, as previously described, disposed within an air pocket 240 formed in a wall portion of the container 260 such as the base wall 262*a* or side wall 262*b*. The air pocket 240 is completely enclosed within the wall portion. It should be appreciated that the tracking device 238 is formed within the air pocket 240 as the container is molded or otherwise formed.

The package 210 may include an integrally formed label (not shown) having a barcode. The barcode enables information, such as cooking time and temperature, to be read by a scanner. For example, a microwave scanner may automatically read the label and automatically enter cooking time and temperature into a device, such as the microwave. Alternatively, the label may include a cooking temperature indicator, such as a strip of temperature-sensitive material which changes color upon reaching a predetermined temperature, so as to provide an indication that the food is properly heated.

The package my include a breathable patch 266 of microporous base film or oxygen transmission patch (OTR) incorporated into the package 210. The incorporation of a breathable patch 266 in the package 210 advantageously allows for venting of gas formed within the package and the intake of oxygen, in order to produce an atmosphere within the package having optimal $O_2$ and $CO_2$ concentrations for preserving the particular product. An example of such a patch is similar to the membrane, and is produced by Landec Corporation, and disclosed in U.S. Pat. No. 6,376,032 which is incorporated by reference. The patch is produced from a microporous film, which respires according to predetermined combinations of $O_2$ permeability and change in $O_2$ permeability, with temperature and ratio of $CO_2$ permeability to $O_2$ permeability. These films are typically supplied as rectangular or square patches having an adhesive strip extending around the periphery, and cover an opening in the wall of the pouch.

The respiration can be controlled by first die cutting a hole 268 in the film of a predetermined size, and affixing the breathable patch 266 over the hole. Because different food products, such as fruits, vegetables and meats, have different rates of decomposition, the amount of gas permeability varies depending on the product contained within the package. The hole size formed in the film may be varied in accordance with the food product contained within the package in order to control the rate of respiration.

In this example, a hot melt or pressure adhesive is used to bond the patch to the film. It should be appreciated that the adhesive should be of sufficient adhesive strength to resist pressure generated by steam during a heating operation, such as microwaving. For example, the adhesive may be applied to the patch in a pair of lines as shown at 270, in order to mount the patch 266 to the film or pouch. Steam produced during the heating of the product may eventually break down the first adhesive line or loosen the second adhesive line. The use of the two adhesive lines increases the adhesion of the patch 266 to the lid or pouch during heating.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A flexible pouch with an integral tracking device, comprising:

a panel having an inner surface and an outer surface, and an upper edge, an opposed lower edge and two side edges extending therebetween;

a tracking device disposed within an enclosed air pocket integrally formed in a flat seam of the panel, said seam extending to a peripheral of an edge of said panel, said edge selected from the group consisting of said upper edge, said opposed lower edge and said two side edges extending therebetween, and wherein said seam is formed by a sealing bar having a recessed portion for forming said enclosed air pocket; and an opening means integrally formed in the panel for accessing a product contained within the pouch.

2. A flexible pouch as set forth in claim 1 wherein the tracking device includes an Radio Frequency Identification (RFID) transmitter.

3. A flexible pouch as set forth in claim 2 wherein the tracking device includes a transponder.

4. A method of forming a flexible pouch having an integrated tracking device using an automated machine, said method comprising the steps of:

forming a body of the pouch from a roll of laminate material, wherein the body of the pouch includes a panel having an inner surface and an outer surface, and an upper edge, an opposed lower edge and a first side edge and an opposed second side edge extending therebetween;

locating a tracking device on the laminate material of the pouch;

sealing the lower edge, first side edge and second side edge using a seal means and forming a seam, the seam extending to a peripheral edge of the lower edge, first side edge and second side edge of the panel, wherein the seal means includes a seal bar having a recessed portion for forming an enclosed cavity, and the recessed portion of the seal bar is positioned relative to the tracking device located on the laminate material, so that the tracking device is disposed within the enclosed cavity and an air pocket formed by the enclosed cavity;

applying an opening means to the panel; and finishing the pouch.

5. A method as set forth in claim 4 wherein the tracking device includes an Radio Frequency Identification (RFID) transmitter.

6. A method as set forth in claim 5 wherein the tracking device includes a transponder.

* * * * *

UNITED STATES PATENT AND TRADEMARK OFFICE

CERTIFICATE OF CORRECTION

PATENT NO. : 7,658,286 B2
APPLICATION NO. : 11/686666
DATED : February 9, 2010
INVENTOR(S) : R. Charles Murray It is certified that error appears in the above-identified patent and that said Letters Patent is hereby corrected as shown below:

Column 6, Line 1 - delete "REID" and insert --RFID--

Signed and Sealed this
First Day of May, 2012

David J. Kappos

David J. Kappos
*Director of the United States Patent and Trademark Office*